United States Patent [19]

Brendle

[11] 4,202,780

[45] May 13, 1980

[54] METHOD FOR IMPROVING THE LUBRICATING PROPERTIES OF SOLID LUBRICANTS

[75] Inventor: Marcel C. Brendle, Wittenheim, France

[73] Assignee: Dow Corning GmbH, Munich, Fed. Rep. of Germany

[21] Appl. No.: 701,922

[22] Filed: Jul. 1, 1976

[30] Foreign Application Priority Data

Jul. 4, 1975 [DE] Fed. Rep. of Germany ..... 2530002

[51] Int. Cl.[2] ..... C10M 7/10; C10M 7/30; C10M 7/48

[52] U.S. Cl. ..... 252/12; 252/25; 427/220; 427/221; 260/45.75 R; 260/45.75 M; 260/45.75 V; 260/45.75 W; 525/4

[58] Field of Search ..... 252/12, 27; 427/220, 427/221; 260/45, 75 R, 75 M, 75 V, 75 W, 823, 824 R, 872

[56] References Cited

U.S. PATENT DOCUMENTS

| | | | |
|---|---|---|---|
| Re. 22,985 | 9/1947 | Collins | 252/29 |
| 2,583,603 | 1/1952 | Sirianni et al. | 252/28 |
| 2,805,961 | 9/1957 | Puddington et al. | 427/221 |
| 2,993,022 | 7/1961 | Coler | 427/221 X |
| 3,208,867 | 9/1965 | Weldes | 106/308 |
| 3,281,362 | 10/1966 | Di Sapio | 252/12 X |
| 3,730,893 | 5/1973 | Bilow et al. | 252/12.4 |
| 3,838,048 | 9/1974 | Hedge et al. | 252/12 |
| 3,839,209 | 10/1974 | Hermann et al. | 252/12 |
| 3,897,586 | 7/1975 | Coker | 427/221 X |
| 3,985,660 | 10/1976 | Lankamp | 252/12 |

FOREIGN PATENT DOCUMENTS

| | | | |
|---|---|---|---|
| 248138 | 5/1963 | Australia | 252/12 |
| 428297 | 8/1969 | Australia | 252/12 |
| 428147 | 1/1970 | Australia | 252/12 |
| 428691 | 2/1970 | Australia | 252/12 |
| 567696 | 12/1958 | Canada | 252/12 |
| 772604 | 11/1967 | Canada | 252/12 |
| 775091 | 1/1968 | Canada | 252/12 |
| 898791 | 4/1972 | Canada | 252/12 |
| 2023708 | 11/1970 | Fed. Rep. of Germany | 252/12 |
| 2440964 | 4/1975 | Fed. Rep. of Germany . | |
| 1432265 | 2/1966 | France | 252/12 |
| 2021235 | 7/1970 | France | 252/12 |
| 335790 | 3/1959 | Switzerland | 252/12 |
| 1123664 | 8/1963 | United Kingdom | 252/12 |
| 1025694 | 4/1966 | United Kingdom | 427/221 |
| 1156652 | 7/1969 | United Kingdom | 427/221 |
| 1204689 | 9/1970 | United Kingdom | 252/12 |
| 1214985 | 12/1970 | United Kingdom | 252/12 |
| 1223561 | 2/1971 | United Kingdom | 252/12 |
| 1236066 | 6/1971 | United Kingdom | 252/12 |
| 1247333 | 9/1971 | United Kingdom | 252/12 |
| 1292818 | 10/1972 | United Kingdom | 252/12 |

OTHER PUBLICATIONS

Chem. Abs. vol. 83, 1975, 81519q "Films of Plastic-Coated Inorganic Powder Particles," Kazuo et al.

Chem. Abs. vol. 80, 1974, 27664h. "Graft Polymerization on Silica", Hoene et al.

Chem. Abs. vol. 54 21668i "The Sublimation of Chlorides Applied to Oxidized Molybdenum Ores", Smakevich.

*Primary Examiner*—Floyd D. Higel

*Attorney, Agent, or Firm*—Robert L. McKellar

[57] ABSTRACT

A process for preparing improved solid lubricants, by modifying the surface characteristics of the solid lubricants using reactive chemical compounds, is disclosed.

Prior art measures anticipate combinations of modifiers and solid lubricants as lubricating mixtures but do not disclose bonding modifiers with solid lubricants.

Examples of the improved modified solid lubricants are molybdenum disulfide chemically bonded to polystyrene, polymethylmethacrylate or polydimethylsiloxane.

12 Claims, 6 Drawing Figures

METHOD FOR IMPROVING THE LUBRICATING PROPERTIES OF SOLID LUBRICANTS

SUMMARY OF THE INVENTION

Figure 1:
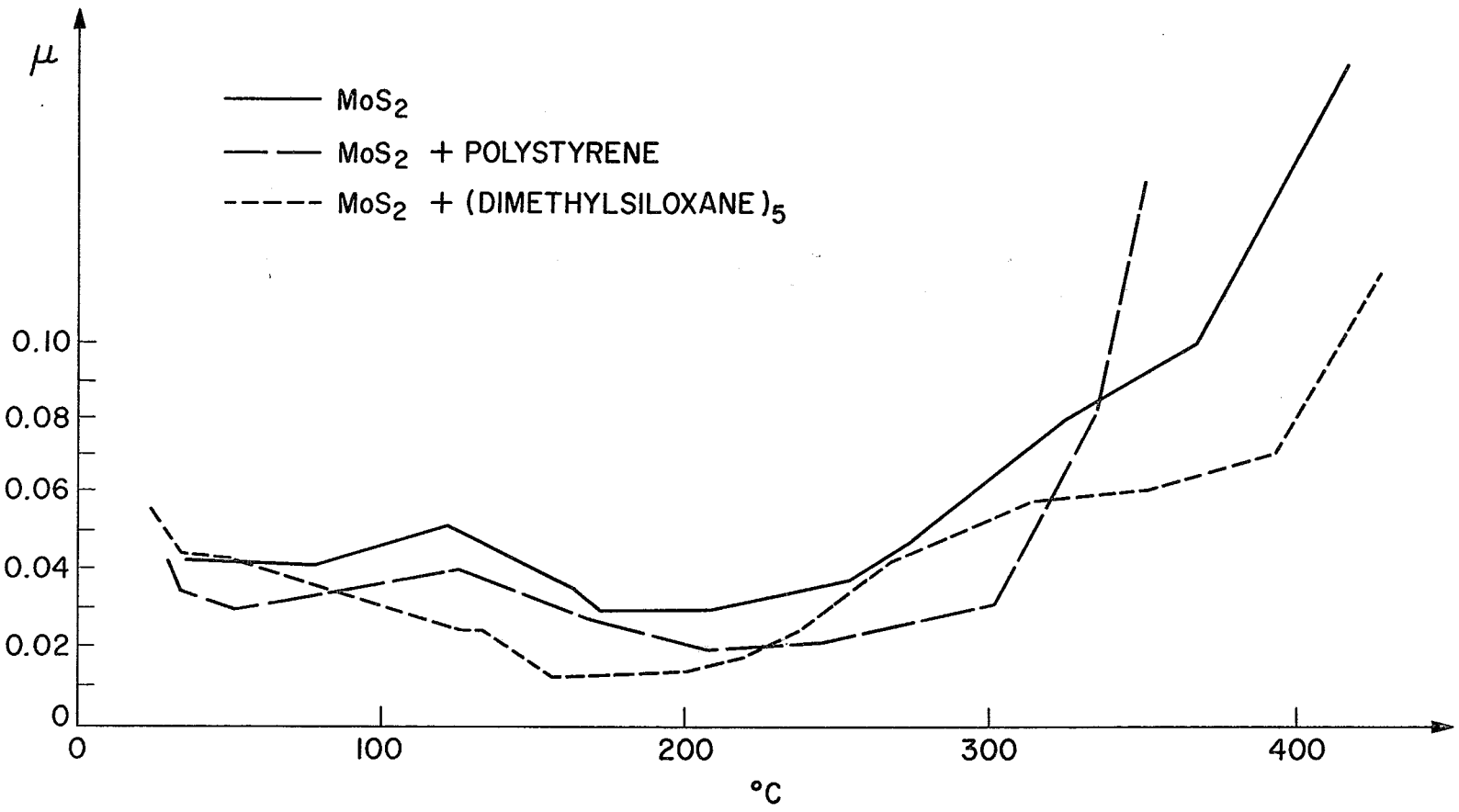

The present invention discloses a process for the preparation of solid lubricants, having improved lubricating properties, by modifying the surface of the solid lubricant. The modification processes vary from the chemical attachment of inorganic groups such as chlorine; the bonding of organic monomers and polymers such as butyl lithium and polystyrene, to attachment such as dipole moment. The processes vary depending on the type of solid lubricant; the physical form of the modifier; the reactive functionalities involved in the solid lubricant and the modifier, and the final form that is desired in the modified solid lubricant.

Polymers such as polysiloxanes, compounds such as butyl lithium, carbon tetrachloride and reactive styrene and inorganic groups such as chlorine have been attached to solid lubricants, such as molybdenum disulfide to give enhanced lubrication and handling properties to the solid lubricants.

PRIOR ART DISCUSSION

This invention concerns a method or process for modifying the lubricating characteristics of solid lubricants.

Solid lubricants are well known to those skilled in the art. There are many references to them in the published literature and they have been covered quite extensively in the patent field.

Usually, the lubricants are used alone, in conjunction with solvents and carriers and, as co-lubricants in oils and greases.

Generally, the solid lubricants are used in a powdered or finely divided form in order to maintain them in a physically stable form. "Finely divided," for purposes of this invention, relates to particle sizes normally associated with commercial solid lubricants when used as lubricants. Because of the high density and high incompatibility of most of these solid lubricants, they are difficult to keep suspended in any sort of carrier or lubricating medium.

Generally, the only solutions to such problems have been to either grind the solids very finely or use large quantities of emulsifiers in order to prolong their stability.

Some of the problems associated with using solid lubricants (other than dispersing instability) are the typical non-adhesion to metal substrates, consistent and uniform lubricant film formation, variable coefficient of friction, corrosion and variable plastic deformation of the lubricated metals (the Rehbinder effect).

The goal of this invention then is to alleviate some or all of the above problems.

THE INVENTION

The problems discussed above can be essentially diminished by the use of the instant invention.

It is therefore an object of this invention to prepare solid lubricants which are stable in dispersions for long periods of time.

It is a further object of this invention to prepare solid lubricants which give adequate adhesion to metal substrates.

It is yet another object of this invention to prepare solid lubricants which give good in-service films on metal substrates.

It is yet another object of this invention to prepare solid lubricants which give lower coefficients of friction than existing solid lubricants.

It is still further an object of this invention to prepare solid lubricants which give reduced corrosion on metal substrates.

All these and other objects are met by this invention which consists essentially of preparing improved solid lubricants which method consists essentially of carrying out a bonding reaction on the surface of the solid lubricant whereby the solid lubricant is bonded to an additional chemical compound.

By "chemical compound," it is meant for purposes of this invention, to include materials containing functional groups which are reactive with the surface of the solid lubricants.

Such materials can be reactive organic polymers such as polyisobutyl vinyl ether, polystyrene, polysiloxanes, polytoluene, polybenzyl, polypyridine and polymethylmethacrylate.

Such materials can also be monomers such as, for example, butyl lithium, carbon tetrachloride or styrene and methylmethacrylate. These materials can also be inorganic groups such as chlorine or similar reactive gases.

For purposes of the invention, the process can be referred to as "grafting." There are at least two methods for grafting in this invention.

The first and probably the most subtle is chemical grafting wherein chemical compounds containing the appropriate functional group are reacted, generally in solution, with finely divided solid lubricants. For purposes of discussion, molybdenum disulfide is the preferred solid lubricant.

Chemical grafting of polymers of functional organic or inorganic groups to solids, in general, is known.

According to *Angew. Makromol. Chemie* 28, 31 (1973) the grafting of polymers to various solid fillers is known. These modifications were undertaken to improve certain properties of the fillers. The enhancement of the lubricating properties of lubricants was not shown nor indicated therein. The purpose of the instant invention is to enhance the lubricating properties of solid lubricants.

The second and most prolific is chemical grafting that takes place strictly through mechanical working of the chemical compounds and the solid lubricants wherein the solid lubricants are milled, for example, in the presence of the chemical compounds. Such mechanical working leads to new reactive sites on the surface of the lubricant.

For example, in the case of $MoS_2$, the transversal breaking of the lamellar structure of $MoS_2$ leads to the formation of ions or free radicals able to induce the growing of polymer chains linked at the surface. Such mechanical working also leads to some physical bonding of the lubricant and the chemical compound. This, of course, is dependent on the type of solid lubricant and chemical compound used.

Mechanical grafting of solids is known from the *Vysokomolekulyarne Soedinenya* 1 (11) pp. 1713 (1959).

With reference to the instant invention, it should be noted that the solid lubricants are used in a finely divided state and the smaller the particle, the greater the specific surface.

Depending on the type of solid lubricant used, various functional groups are located on its surface. In spite of the very small numbers of chemical functionalities on these surfaces, they have a significant influence on the properties of the solid lubricant.

In the case of $MoS_2$, the surface is normally covered with hydrated molybdenum trioxide, especially if the $MoS_2$ has not been freshly worked.

Because of the presence of the $MoO_3$, the $MoS_2$ has a higher than normal coefficient of friction and other properties are likewise adversely affected.

Thus, there is a constant search for means to improve the properties of solid lubricants.

One would like to have adhesion to metal, improvements in formation of the lubricant films, decrease in the coefficient of friction, decrease in corrosion and alleviation of the plastic deformation of metals (Rehbinder effect).

This goal is attained by means of the inventive process mentioned at the outset of this discussion, namely the modifying of the surface of solid lubricants by bonding either polymers or functional organic or inorganic groups in a chemical fashion with the solid lubricants.

For purposes of this invention, the surface of the solid lubricant is modified by up to 7 percent by weight of the polymers or functional organic or inorganic groups, preferably 2–3 percent by weight.

For purposes of illustration, the most preferred polymers are polyisobutylvinylether, polystyrene, polysiloxanes such as polydimethylsiloxane or polymethylphenylsiloxane, polytoluene, polybenzyl, polypyridine or polymethylmethacrylate.

These polymers are normally produced in situ by adding the monomeric precursors to the solid lubricant and carrying out simultaneous reactions, that is, polymerization of the precursor monomer and, attachment to the solid lubricant.

For chemical bonding organic or inorganic groups, there can be used organometallic compounds, organohalogen compounds, organic compounds with activatable unsaturated bonds, or simply halogens such as chlorine.

It is within the scope of this invention to use combinations of the organic compounds, combinations of the polymers or combinations of the organic compounds and polymers.

Specific examples of solid lubricants include metal oxides, hydroxide, sulfide, phosphates, halides, and soaps. More specific examples include graphite, tungsten disulfide, barium hydroxide, lead monoxide, lead chloride, lead iodide, borax, cadmium iodide, cobalt chloride, zinc stearate, boric nitride, calcium fluoride, zinc sulfide or molybdenum disulfide.

Especially preferred is molybdenum disulfide.

The treatment of the solid lubricants according to the invention can be undertaken with or without preliminary cleaning of the surface of the solid lubricants.

In the case of molybdenum disulfide, such surface cleaning can be achieved by treating the solid by placing in a vacuum at an elevated temperature, say, $10^{-6}$ Torr and 450° C. (see for example R. R. M. Johnson, A. J. W. Moore J. Phys. Chem. 1964, 68 (11) pp. 3399). The cleaning can also be accomplished by washing the solid with ammonium hydroxide solution.

Both methods removed the molybdenum trioxide present on the surface of the molybdenum disulfide.

Such a cleaning treatment is preferred but not required for this invention.

The actual reactions used in the grafting process are generally well known reactions.

Polymers or functional groups can be bound to the surfaces of the solid lubricant by transfer reactions of cationically or anionically living polymers. They can also be attached by means of mechanical stress in the presence of monomers, such as, for example, during milling. Another means is by simple contact of the solid lubricant by halogens such as chlorine, either in gas form at elevated temperatures or in the form of solutions, for example, carbon tetrachloride. Some effect of grafting is even observed on simple mixing of the solid lubricants and the corresponding polymers. This aspect, however, does not form part of this invention.

The grafting can best be carried out by bringing the solid lubricant, for example, molybdenum disulfide together with solutions of active polymers, for example, polystyrene solutions. Such active polymer solutions are known from *Nature,* 178, 1168 (1956) or *Makromol. Chem.* 35, 132 (1960).

They are, for example, polystyrene formed according to an anionic growth mechanism which leaves reactive sites available on the end of the chains. These solutions are solvent based. Toluene and tetrahydrofuran are preferred.

In the same manner, one can also react molybdenum disulfide with butyl lithium in such a way that the butyl radical is bound onto the molybdenum while the lithium cation enters into a bond with the sulfidic sulfur. The lithium atoms present on the metal surface can be separated by reaction with reactive molecules which possess an active halogen atom, such as benzyl chloride or a polysiloxane of the formula $$Cl[(CH_3)_2SiO]_n—Si(CH_3)_3$$

where n stands for a positive integer, preferably 5 in this case.

The siloxane chain is bound through the chloride silicon to the sulfur of the molybdenum disulfide and the lithium is cleaved to form lithium chloride using the chlorine atom from the siloxane molecule.

Now, so that one can better understand the invention, the following examples are given.

EXAMPLE 1

20 g. molybdenum disulfide were placed in a ball milling container provided with steel spheres. The ball milling container was then evacuated, and, with water completely excluded, 345 ml. of a 30% solution of isobutylvinyl ether in methylene chloride was added. The ball milling container was then put into a suitable milling apparatus, and the entire material was milled for 24 hours. The flowable material obtained in this manner was then washed with methylene chloride to remove the excess of unbound polymer as well as any monomer present, and finally dried under a vacuum.

EXAMPLE 2

In a 4 l three-necked flask provided with agitator, an addition funnel, and tubes for introducing gases as well as for evacuating air, and after careful evacuation of the air and after introduction of nitrogen, 150 g. of freshly distilled dried styrene, 1500 g. distilled and dried toluene, and 150 g. distilled and dried tetrahydrofuran were added with agitation. Then the entire mixture was cooled to −80° C. Then butyl lithium was injected into the flask until the reaction mixture just turned red. The quantity of butyl lithium necessary for the red coloring corresponding to the residual water still present in the reaction mixture. Then further butyl lithium was added in a quantity such that the desired molecular weight for the polystyrene to be grafted on resulted. In the present case, 0.25 g. butyl lithium were necessary for this purpose. Then the preparation was heated for about 2 hours at 30° to 40° C., whereupon polymerization occurred. After the lapse of this time, vigorous stirring and cooling of the batch to room temperature, 30 g. molybdenum disulfide was added, and allowed to react 8 to 12 hours. The reaction mixture thus obtained was then decanted, and the grafted molybdenum disulfide remaining behind was washed out repeatedly with tetrahydrofuran.

To determine the quantity of the polystyrene grafted onto the molybdenum disulfide, the product obtained in this fashion was subjected to an elemental analysis. A carbon content of 2.01%, which corresponds to a quantity of polystyrene of 2.18% was present on the molybdenum disulfide.

The solution obtained by the above-described washing of the grafted molybdenum disulfide with tetrahydrofuran was subjected to a gel permeation chromatography in order to determine the molecular weight of the polystyrene which formed in the course of this process. Here one obtained an average molecular weight of 38,000. This molecular weight value also holds for the polystyrene grafted onto the molybdenum disulfide.

EXAMPLE 3

The process described in Example 2 was repeated in all its particular, except that in place of the quantity of butyl lithium indicated there, we used a smaller quantity of butyl lithium, namely a total of 0.11 g.

The determination of the carbon content of the polystyrene grafted onto the molybdenum disulfide yielded a value of 1.99%, which corresponded to a polystyrene quantity of 2.15%. The average molecular weight of the polystyrene produced in this manner and then grafted onto the molybdenum disulfide amounted to 84,000.

EXAMPLES 4–8

According to the procedure generally described in Example 2, using suitable starting materials, polydimethylsiloxane, polytoluene, butyl lithium, butyl lithium and benzyl chloride, as well as chlorine, were grafted onto molybdenum disulfide.

EXAMPLE 9

A solution of 2.5 g. polystyrene (molecular weight 50,000) in 200 ml. toluene was added to 100 g. molybdenum disulfide with vigorous stirring at room temperature. The entirety was stirred for two hours. The suspension obtained in this manner was evaporated under a vacuum to remove the solvent, and the residue thus obtained was powdered. The suspension can, however, be used for direct coating of objects which are to be provided with a lubricant film without evaporation of the solvent.

EXAMPLES 10 AND 11

The process described in Example 9 is repeated in all its particular, except that in place of polystyrene, polybenzyl (molecular weight about 5000) and polypyridine (molecular weight about 1000) was used.

The materials produced according to the above examples are worked up into a lubricant film whose working life was studied on the LFW-1 test machine. The results thus obtained can be seen in the table, in which the number of rotations is given which the film sustained to the point of failure. The LFW-1 test machine is well known to those skilled in the art. For further details see U.S. Pat. No. 3,028,746.

The behavior of molybdenum disulfide grafted with polystyrene, molybdenum disulfide grafted with $(CH_3)_3Si[OSi(CH_3)_2]_5Cl$, as well as of untreated molybdenum disulfide is studied in the pin and disc machine, and the results thus obtained appear in FIG. 1. The pin and disc machine is well known to those skilled in the art and needs no further elaboration here. Here we are dealing with a product created by chemical grafting.

Figure 2:
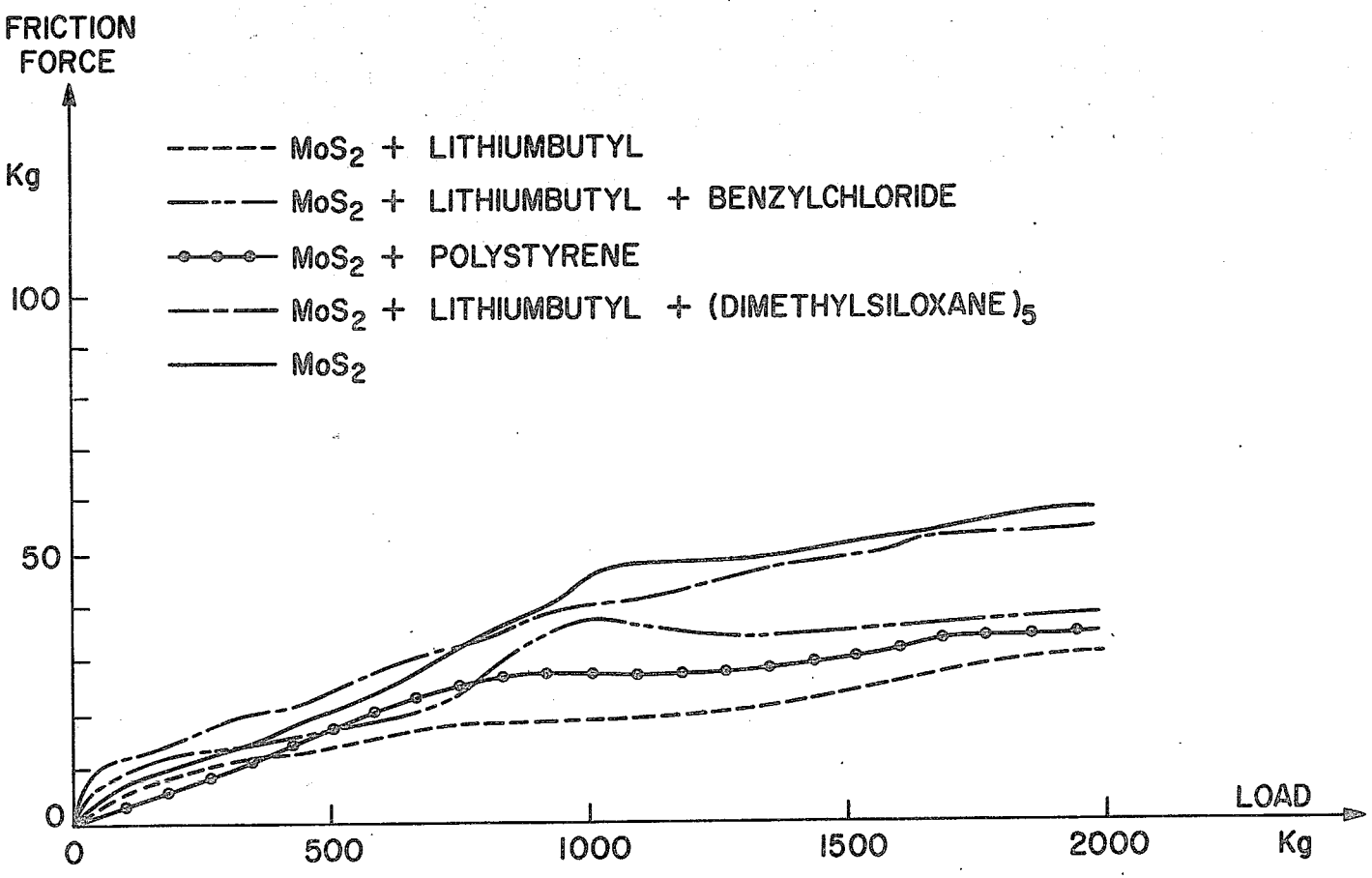
Figure 3:
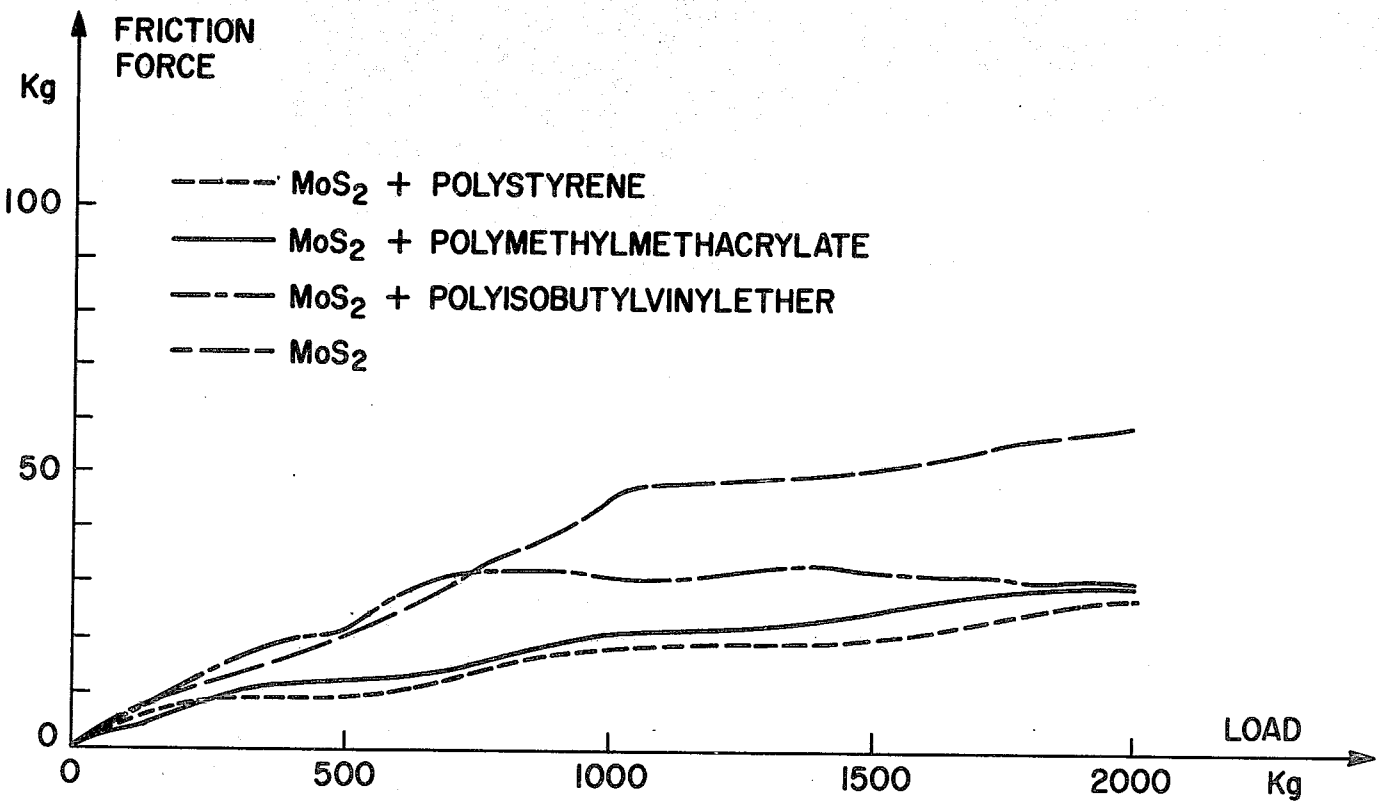

Several of the products produced according to the invention are studied in the Almen-Wieland machine (A.W.M.) in order to determine their friction properties (see L. Dorn, R. Lindner, Schmierungstechnik 1971, 2 (8) p. 243). The results obtained can be seen in FIG. 2 and 3. In FIG. 2 one can observe tests using chemically grafted materials, and in FIG. 3, tests with mechanically grafted materials are shown. It is obvious that the friction forces obtained with the grafted molybdenum disulfide are clearly lower than for untreated molybdenum disulfide.

Figure 4:
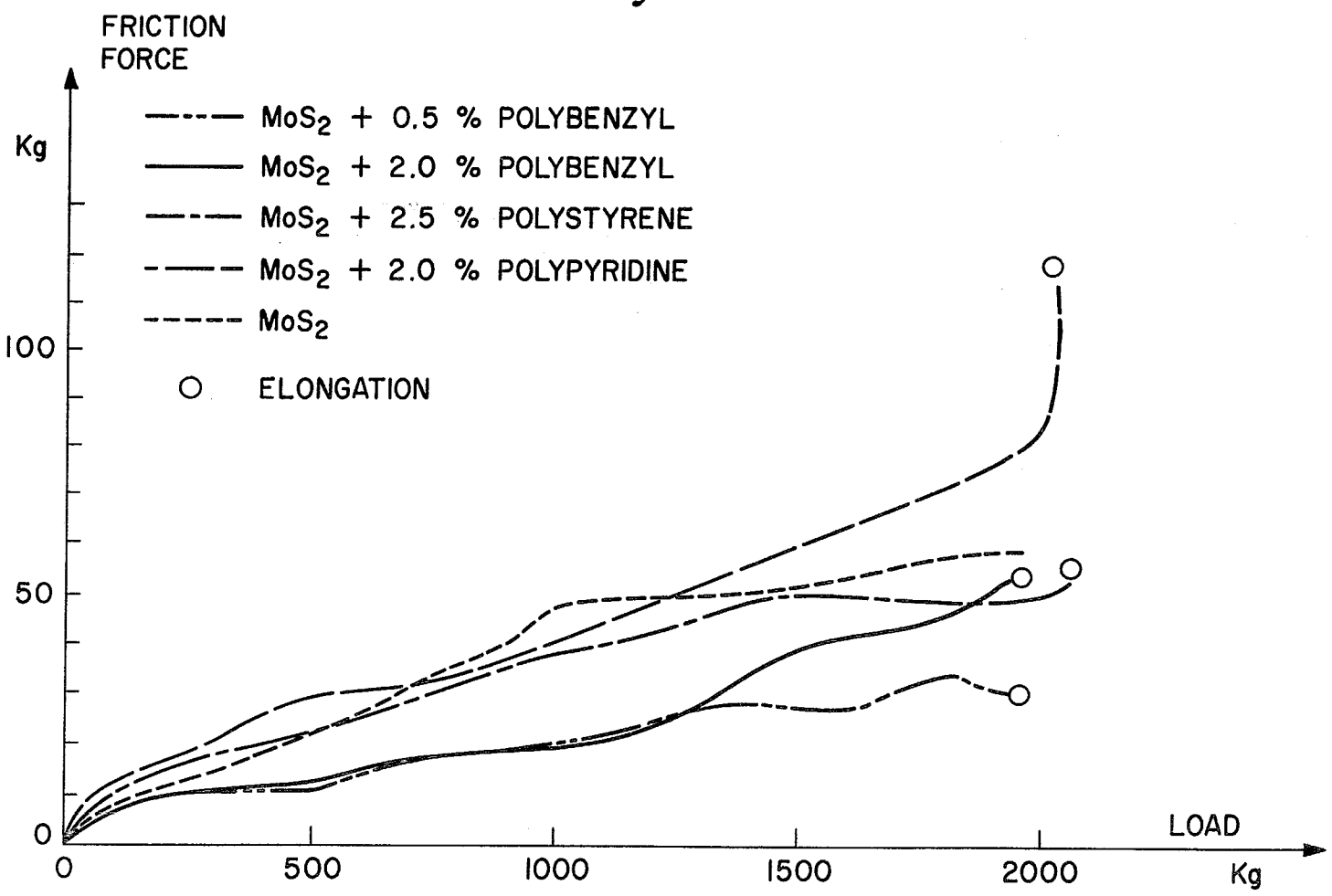

The frictional behavior on the Almen-Wieland machine of mixtures of molybdenum disulfide and various polymers in the indicated quantities appears from FIG. 4. With the symbol O located at the end of the individual curves it is indicated that in these cases, an elongation of the test shaft has occurred. Such an elongation can be explained with the aid of the Rehbinder effect.

Figure 5:
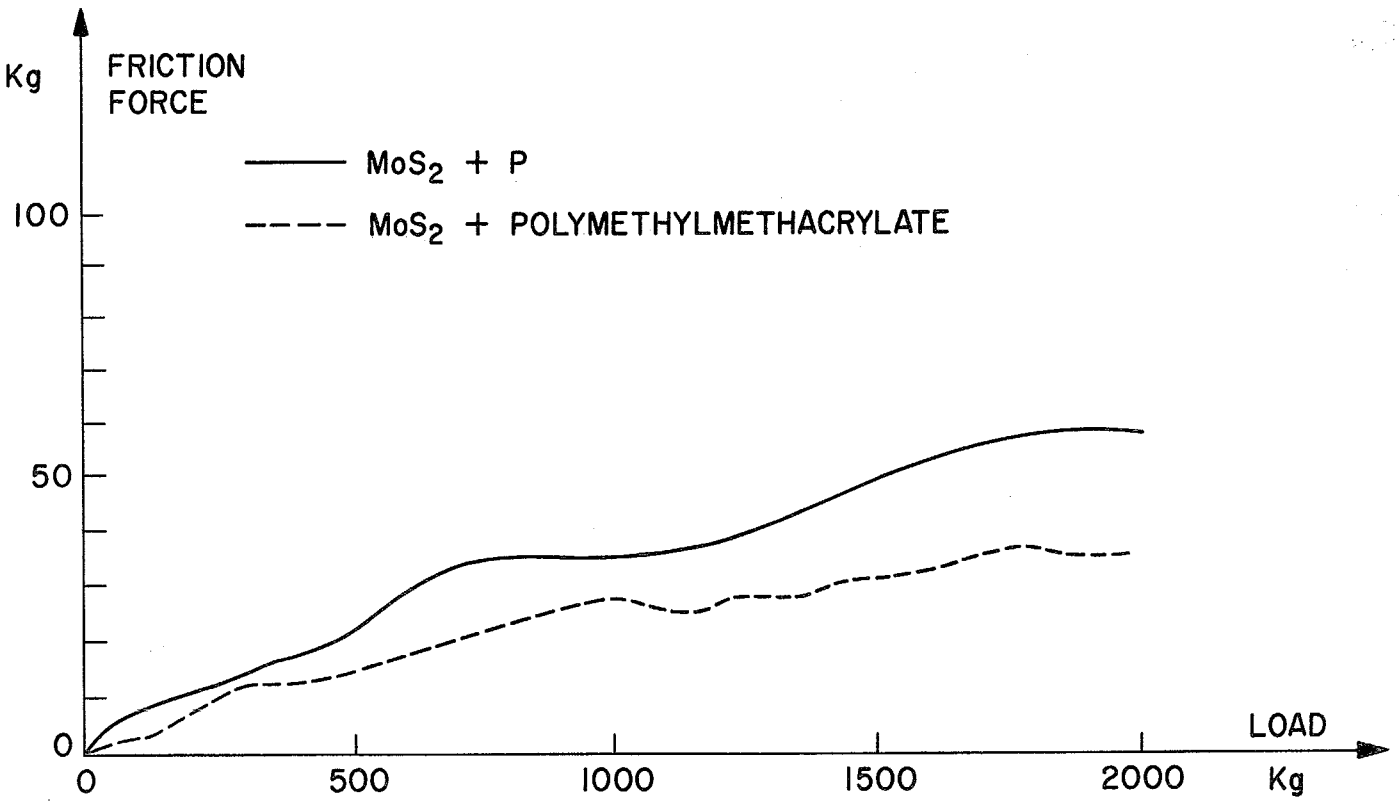

In FIG. 5 one can see the A.W.M. frictional behavior of molybdenum disulfide mechanically grafted with polymethylmethacrylate; it was treated with a dilute acid for partial hydrolysis of the ester groups present, so that the graft polymer was available as the acid and ester groups. It is noteworthy that this product adheres well and leads to very good frictional values for all stresses.

An interesting phenomenon shown by all the products of the invention is the drastic deformation of test shafts of the Almen-Wieland machine, which is manifested by the fact that after the experiments the test shafts are longer.

Figure 6:
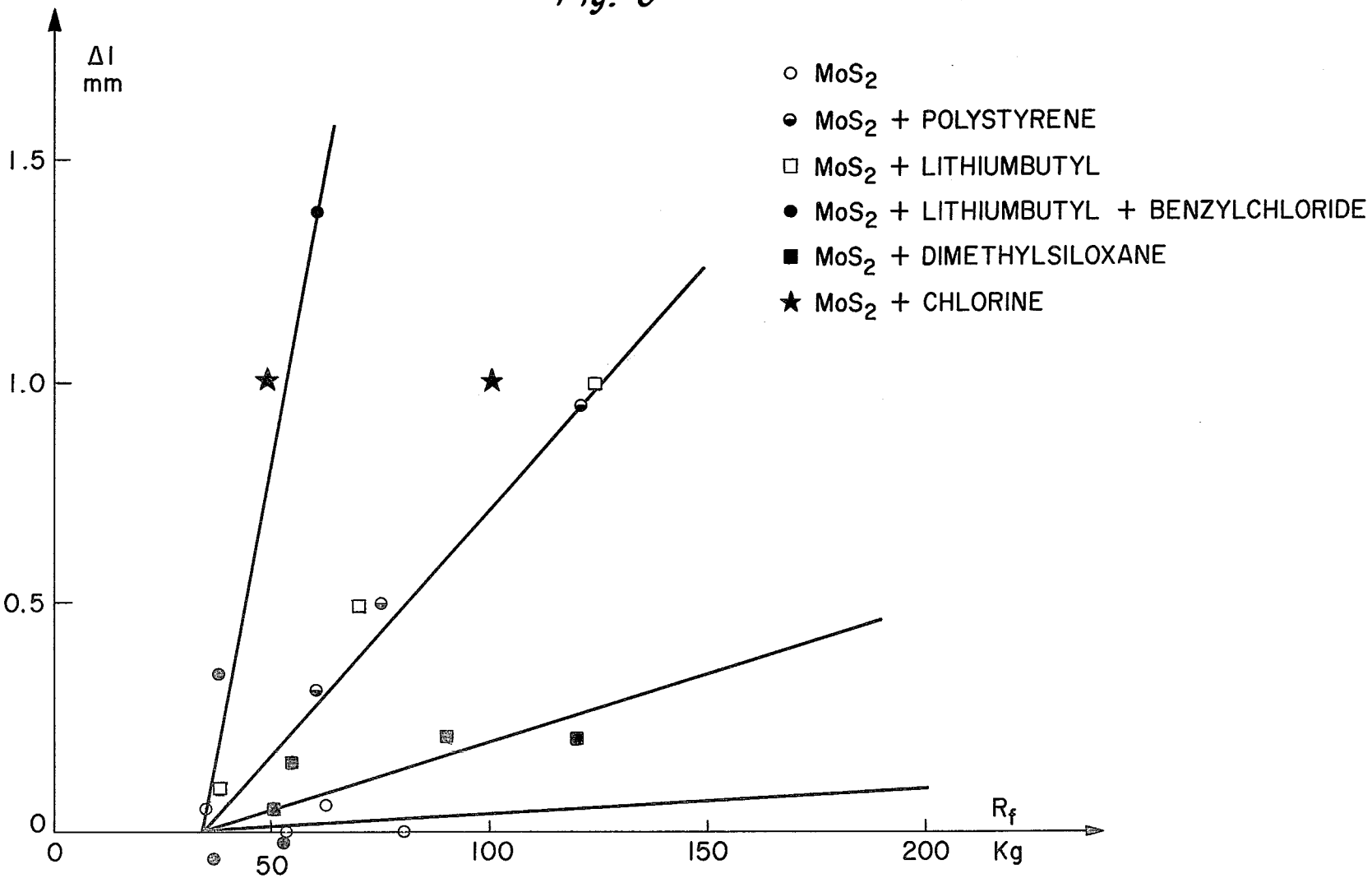

The results obtained from the A.W.M. appear in the appended FIG. 6. It is evident that, under the same conditions, for each grafted product, there is a linear relationship between the extent of the elongation in mm and the final value of the frictional force in kg. The slope of the resulting straight line is a function of the nature of the grafted polymer. These results are connected with the Rehbinder effect and play a large part in diminishing the frictional values.

The above-mentioned values show that the products produced according to the invention are distinquished by a series of interesting modes of behavior. Moreover, the properties for dry lubricants, including, for example, the fact that they adhere extremely well to smooth metal surfaces and there is no occurrence of corrosion on the metal objects treated with them. Electron micrographs show the dry lubricants produced according to the invention can be coated in a better way and more uniformly as films on corresponding carriers than is the case for pure molybdenum disulfide.

EXAMPLES 12 AND 13

The process described in Example 1 is repeated in its particulars, except that in place of the isobutylvinyl ether used there, one uses methylmethacrylate or styrene as monomers.

EXAMPLE 14

When isobutylvinylether was grafted onto finely divided $MoS_2$, very stable suspensions in THF, of the grafted product, were observed.

TABLE

| Example No. | Treatment of molybdenum disulfide with | Sandblasted rings (revolution $\times 10^{-3}$) | Unheated rings (revolution $\times 10^{-3}$) |
|---|---|---|---|
| — | Unheated molybdenum disulfide | 60 to 120 | 0.8 to 4.5 |
| 1 | Polyisobutyl vinyl ether | 200 | |
| 2 & 3 | Polystyrene | 80 to 100 | |
| 4 | Polysiloxane | 80 to 100 | |
| 5 | Polytoluene | 40 to 80 | |
| 6 | Butyl lithium | 120 to 130 | |
| 7 | Butyl lithium and benzyl chloride | 90 | |
| 8 | Chlorine | 60 to 120 | 40 to 130 |
| 10 | Polybenzyl | 140 to 180 | |
| 11 | Polypyridine | 75 to 140 | |
| 12 | Polymethylmethacrylate | 130 to 180 | |
| 13 | Polypyridine | 75 to 140 | |

That which is claimed is:

1. A process for improving the lubricating properties of solid lubricants characterized by modifying the solid lubricants by
   (A) contacting finely divided solid lubricants with an organic solvent solution of reactive organic polymer;
   (B) allowing the finely divided solid lubricant to remain in contact with the solvent solution of reactive organic polymer for a period sufficient to allow the solid lubricant to react with the reactive polymer and attach the organic polymer to the solid lubricant;
   (C) washing the reaction product free of impurities using organic solvents;
   (D) removing the solvent and recovering the solid lubricant that has been so modified,
   whereby a solid lubricant is obtained which has improved lubricating properties.

2. A process as claimed in claim 1 wherein the solid lubricant is molybdenum disulfide and the reactive organic polymer is living polystyrene.

3. A process as claimed in claim 1 wherein the solid lubricant is molybdenum disulfide and the organic polymer is polyisobutylvinylether.

4. A process as claimed in claim 1 wherein the solid lubricant is molybdenum disulfide and the organic polymer is polydimethylsiloxane.

5. A process as claimed in claim 1 wherein the solid lubricant is molybdenum disulfide and the organic polymer is polytoluene.

6. A process as claimed in claim 1 wherein the solid lubricant is molybdenum disulfide and the organic polymer is polybenzyl.

7. A process as claimed in claim 1 wherein the solid lubricant is molybdenum disulfide and the organic polymer is polypyridine.

8. A composition of matter which is a solid lubricant which is chemically bonded with an organic polymer.

9. A composition of matter which is a solid lubricant which is chemically bonded with an organic polymer selected from the group consisting of
polyisobutylvinyl ether
polystyrene
polysiloxane
polytoluene
polybenzyl
polypyridine and,
polymethylmethacrylate.

10. The use of a modified solid lubricant for lubricating purposes which solid lubricant has been modified by
   (A) contacting a finely divided solid lubricant with a reactive gas;
   (B) allowing the solid lubricant and the gas to remain in contact for a period of time sufficient to allow the gas to react with the solid lubricant;
   (C) recovering the solid lubricant that has been so modified.

11. A use as claimed in claim 10 wherein the solid lubricant is molybdenum disulfide which has been modified with a halogen.

12. A use as claimed in claim 10 wherein the solid lubricant is molybdenum disulfide which has been modified with chlorine.

* * * * *